United States Patent [19]

Dewees et al.

[11] Patent Number: 4,726,634

[45] Date of Patent: Feb. 23, 1988

[54] OUTDOOR DISPLAY CABINET

[75] Inventors: John G. Dewees, Morristown; Rickey Martins, Lynohurst, both of N.J.

[73] Assignee: Champion Spark Plug Company, Toledo, Ohio

[21] Appl. No.: 947,182

[22] Filed: Dec. 29, 1986

[51] Int. Cl.[4] ..... A47B 81/00; B65D 43/24

[52] U.S. Cl. ..... 312/100; 312/250; 312/269; 217/60 E

[58] Field of Search ..... 312/100, 244, 291, 292, 312/102, 250, 229, 270, 269, DIG. 33; 217/60 E

[56] References Cited

U.S. PATENT DOCUMENTS

| | | | |
|---|---|---|---|
| 892,184 | 6/1908 | Rangnow | 217/60 E |
| 963,469 | 5/1911 | Stocker | 312/DIG. 33 |
| 1,651,784 | 12/1927 | Ulrich | 217/60 E |
| 1,671,359 | 5/1928 | Feist | 312/100 |
| 1,696,317 | 12/1928 | O'Boyle | 312/100 |
| 2,607,649 | 8/1952 | Johnson | 312/269 |
| 2,622,644 | 2/1953 | Heys | 312/DIG. 33 |
| 3,756,219 | 9/1973 | Snyder et al. | 217/60 E |
| 4,085,987 | 4/1978 | Vartdal | 312/DIG. 33 |
| 4,302,857 | 12/1981 | Kodet et al. | 312/250 |

*Primary Examiner*—Victor N. Sakran

*Attorney, Agent, or Firm*—MacMillan, Sobanski & Todd

[57] ABSTRACT

The present invention relates to a unique mobile outdoor display cabinet which can be utilized, for example, to store and display automotive replacement parts at service stations. The display cabinet includes an open ended container adapted to contain a supply of the goods to be displayed, and a cover pivotally attached to the container for closing the open end of the container. The cover is counterweighted to stabilize and maintain the cover in either a closed position or an open position. The container includes a stop surface for limiting the pivotal movement of the cover in one direction to define the open position. In accordance with the present invention, the cover is provided with a panel section which, when the cover is in the open position, is spaced above and extends over the open end of the container to shelter the open end and protect the interior of the container. The display cabinet of the present invention includes additional features which are directed to increasing the overall weather resistance of the cabinet and providing superior protection for the goods contained therein.

20 Claims, 10 Drawing Figures

OUTDOOR DISPLAY CABINET

BACKGROUND OF THE INVENTION

The present invention relates generally to the field of display cabinets and, in particular, to a mobile display cabinet, designed specifically for outdoor use, for the sale of automotive replacement parts such as, for example, windshield wiper blades.

In the sale of consumer products, while there is no substitute for a quality product, it is well known that the manner in which a particular product is packaged, displayed, and promoted has a definite impact on the ultimate success of the product. By neatly packaging a product, arranging the product in an attractive display, and locating the display where it can be easily viewed by a large number of potential customers, the success of a particular product can be greatly improved. For example, automotive service stations have found that by attractively displaying automotive products such as oil or windshield wiper blades in an outdoor display near the gas pumps, the sale of these products is greatly increased.

Outdoor display cabinets have previously been used to display and sell goods such as, for example, automotive replacement parts and the like. However, while intended for outdoor use, such prior art cabinets have not provided the desired amount of weather resistance necessary to effectively shelter the contents from the elements such as rain or snow, from ultraviolet radiation produced by the sun, and from wind blown dirt.

SUMMARY OF THE INVENTION

The present invention relates to an attractive and uniquely constructed mobile outdoor display cabinet which can be utilized by automotive service stations to display automotive replacement parts such as, for example, windshield wiper blades. In addition, the display cabinet can be used for a variety of other applications which require a mobile, generally weather resistant storage or display cabinet.

The display cabinet of the present invention includes a cover pivotally attached to a container adapted to contain a supply of the goods to be displayed. The cover and container cooperate to shelter the contents within the container from weather, ultraviolet radiation, and wind blown dirt. The unique construction of the present invention enables the contents in the container to be sheltered when the cover is either in an open position or a closed position. Also, in accordance with the present invention, the cover is provided with a counterweight means for stabilizing and maintaining the cover in either the open position or the closed position.

More specifically, the cover includes a panel section which cooperates to close an open end of the container when the cover is in its closed position. When the cover is in its open position, the panel section is spaced above and extends completely over the open end of the container to shelter the open end and protect the interior of the container. The container is provided with a stop means which is engagable with the cover for limiting the pivotal movement of the cover in one direction to define the open position. In the preferred embodiment of the invention, the container is supported above a ground surface by a support frame which includes wheel means engaging the ground surface. The display cabinet further includes a removable insert member having a plurality of individual partitions for dividing the interior of the container into a plurality of individual compartments.

The display cabinet of the present invention includes other weather resistant features, such as forming the top and bottom walls of the container at an incline, and providing an aperture in a lowermost portion of the bottom wall of the container to permit drainage of any water which may inadvertently enter the container. The cover further includes an inclined upper panel section which faces generally upwardly and includes a lower edge portion hingedly attached to the container. The upper panel section of the cover is provided with a rain groove spaced from the edge portion for directing any water or rain which accumulates on the upper panel section of the cover away from the hinge area.

The display cabinet of the present invention not only provides an effective means for protecting the contents, but also provides an extremely attractive display which can easily be relocated from one location to another.

BRIEF DESCRIPTION OF THE DRAWINGS

The above, as well as other advantages of the present invention, will become readily apparent to one skilled in the art from reading the following detailed description of the invention in conjunction with the attached drawings, in which.

DESCRIPTION OF THE PREFERRED EMBODIMENT

Figure 1:
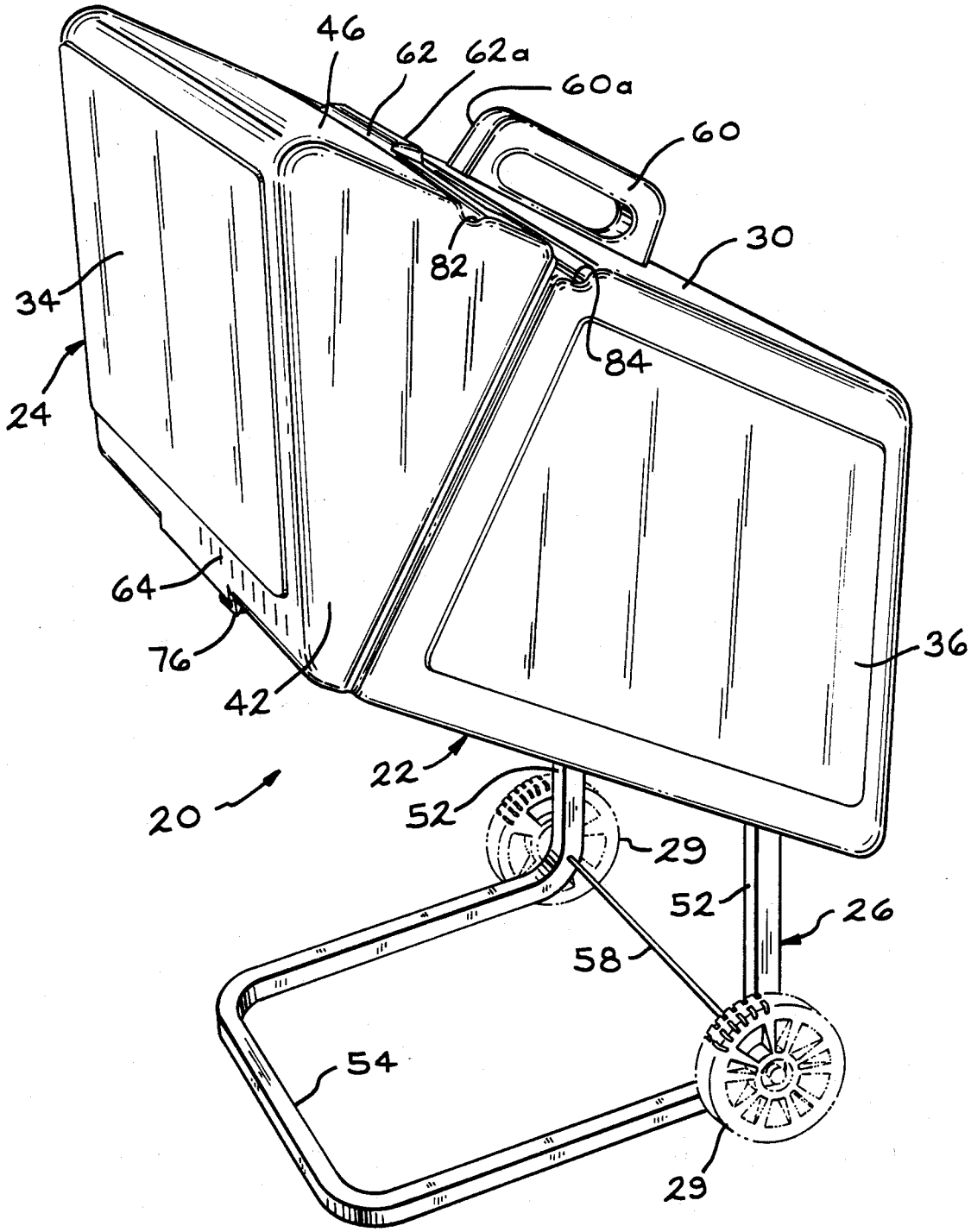
FIG. 1 is a perspective view of a preferred embodiment of an outdoor display cabinet of the present invention having a pivotally attached, counterweighted cover shown in a closed position.

Referring now to FIGS. 1 through 6, there is shown a display cabinet, generally represented by reference numeral 20, embodying the features of the present invention. The display cabinet 20 includes an open ended container 22 adapted to contain and display a quantity of goods in a manner which will be discussed, and a unique cover 24 pivotally secured t the container 22. A supporting frame 26 is secured to the lower side of the container 22 and extends downwardly to a substantially horizontal supporting surface 28 (see FIG. 3) which, in the intended environment of the invention, is typically asphalt or concrete pavement. The lower end of the support frame is provided with ground engaging wheels 29 to facilitate transporting the cabinet from one location to another.

Figure 2:
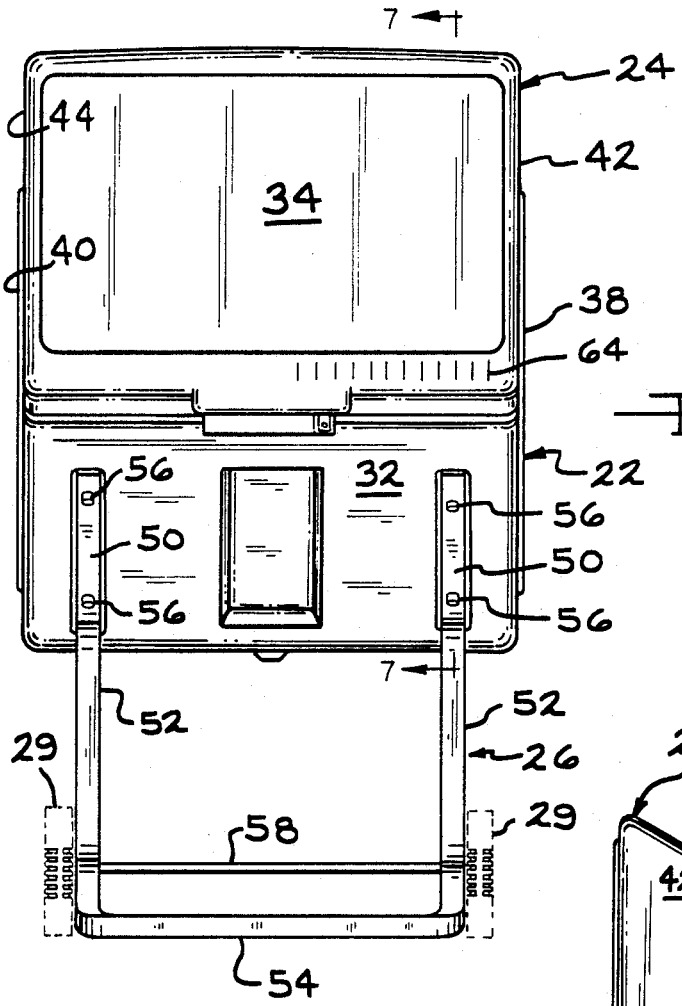
FIG. 2 is a front elevational view of the display cabinet of FIG. 1.
Figure 3:
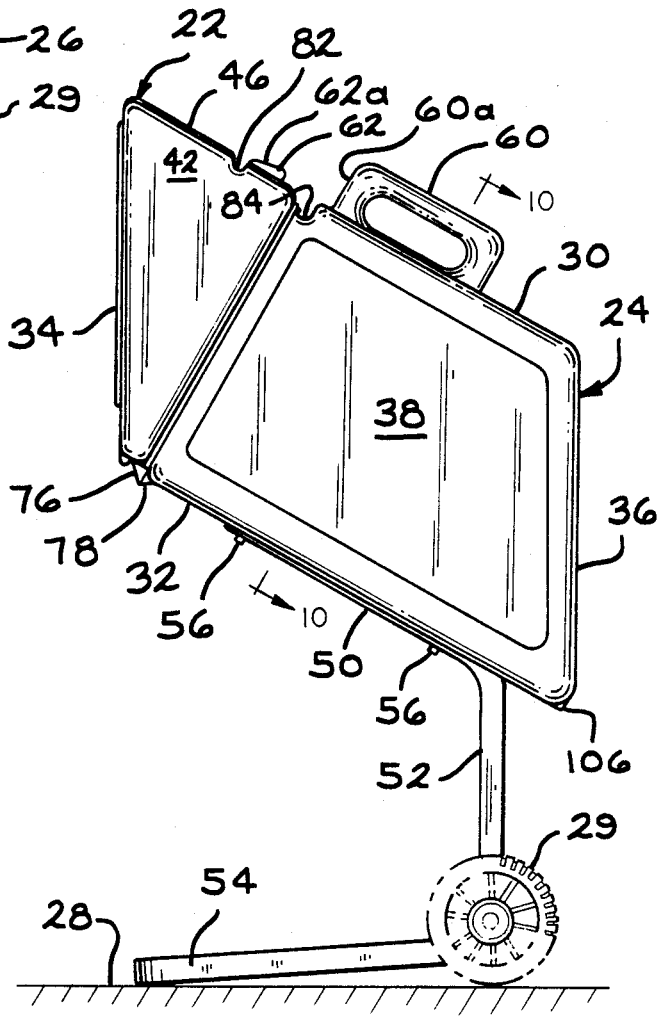
FIG. 3 is a side elevational view of the display cabinet of FIG. 1.
Figure 4:
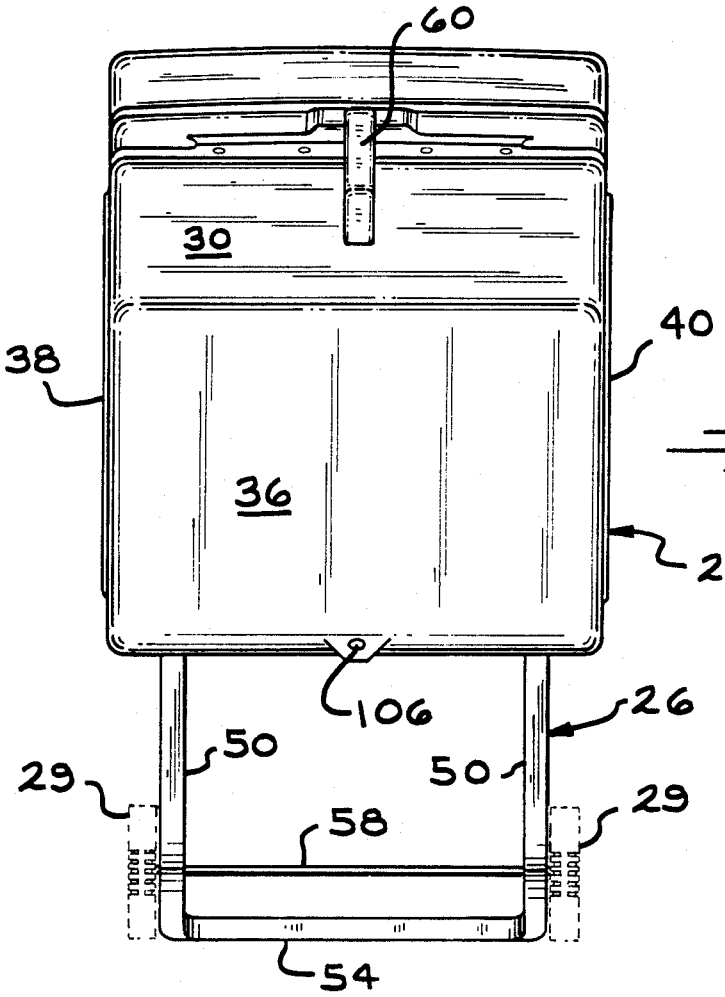
FIG. 4 is a rear elevational view of the display cabinet of FIG. 1.
Figure 5:
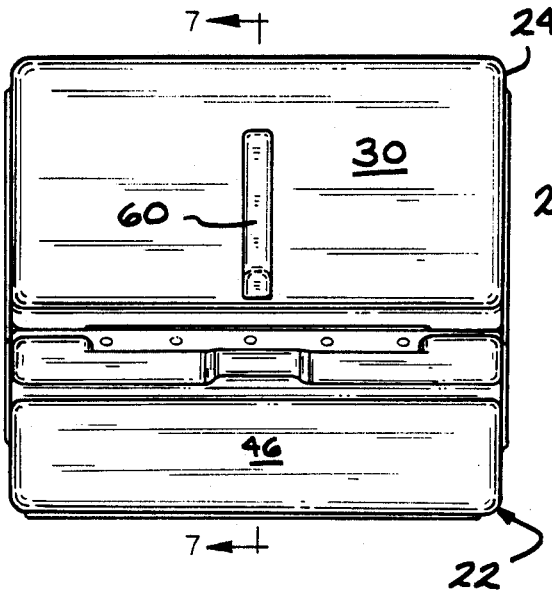
FIG. 5 is a top elevational view of the display cabinet of FIG. 1.
Figure 6:
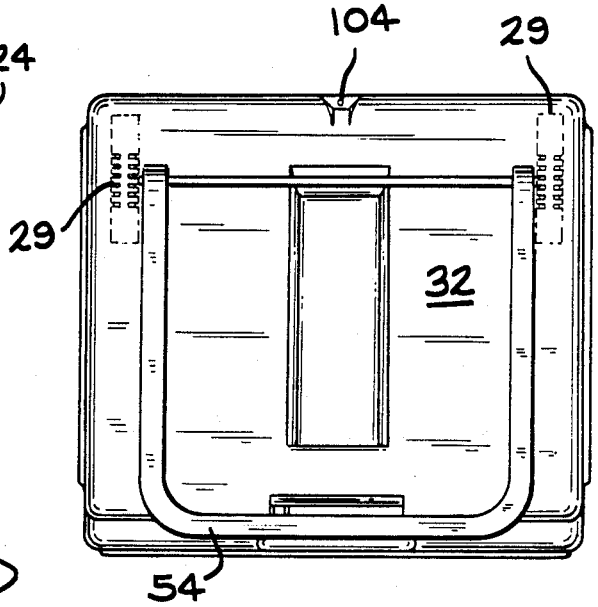
FIG. 6 is a bottom elevational view of the display cabinet of FIG. 1.

When the cover is in its closed position as shown in solid lines in FIG. 1, the container 22 and the cover 24 cooperate to define a generally parallelepiped-shaped cabinet having inclined top and bottom panels 30 and 32 (shown in FIGS. 5 and 6), generally parallel front and rear panels 34 and 36 (shown in FIGS. 2 and 4), and generally parallel side panels 38 and 40 (shown in FIGS. 2 and 3). The cover 24 itself is defined by triangular portions 42 and 44 of the side panels 38 and 40 respectively, an inclined rectangular portion 46 of the top panel 30, and the front panel 34. Typically, the container 22 and cover 24 are formed of a plastic material and are produced by a conventional blow molding operation.

As shown in FIGS. 2 and 3, the support frame 26 includes a pair of spaced apart inclined members 50 secured to the bottom panel 32 of the container 24, a pair of generally vertical members 52 extending downwardly from the inclined members 50, and a generally U-shaped lower ground engaging member 54 having leg portions secured to the lower ends of the members 52. Typically, the members 50, 52, and 54 are formed from a single length of tubular bar stock.

Figure 7:
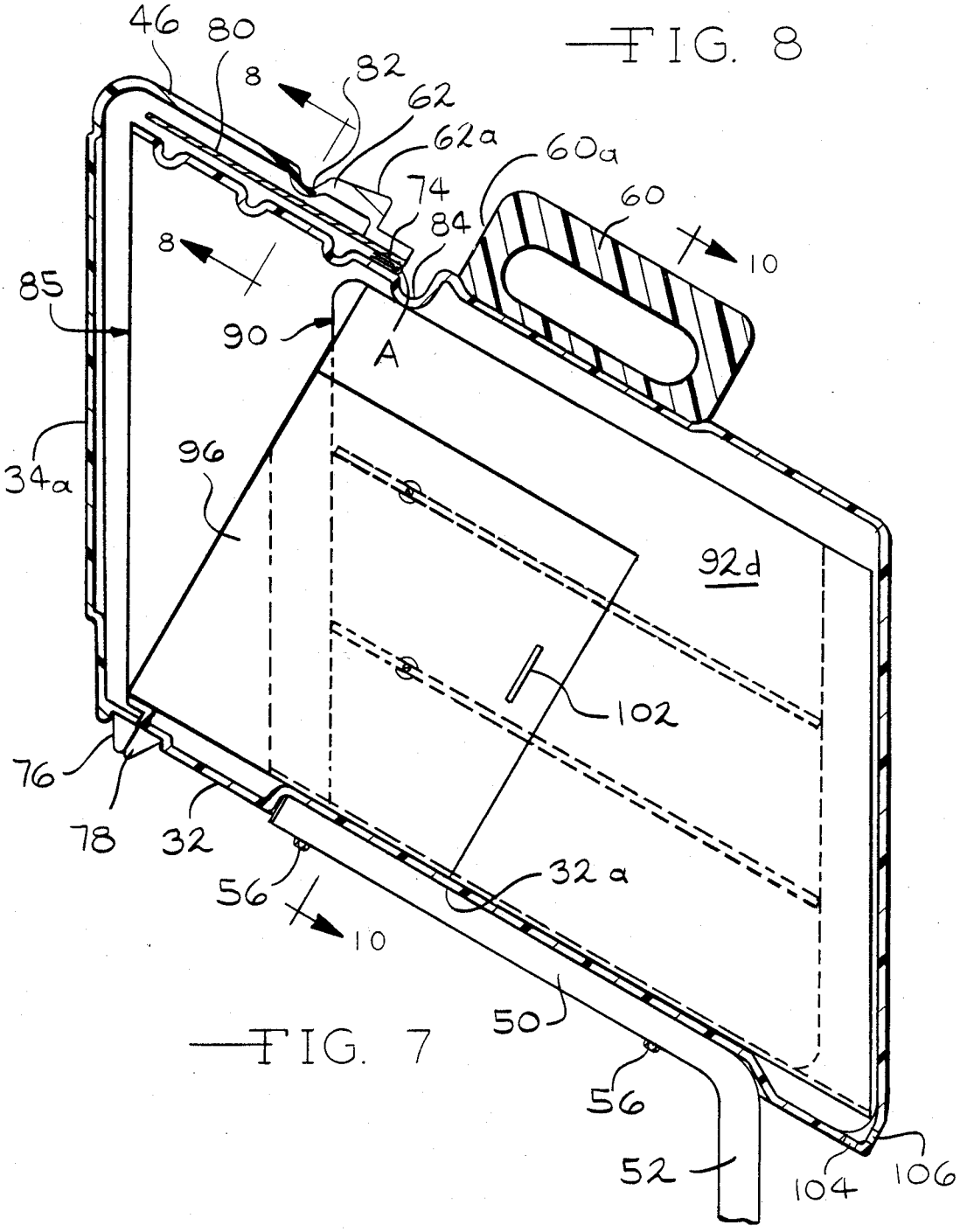
FIG. 7 is a sectional view taken along the line 7—7 in FIG. 2, with the removable insert member shown in elevation.
Figure 10:
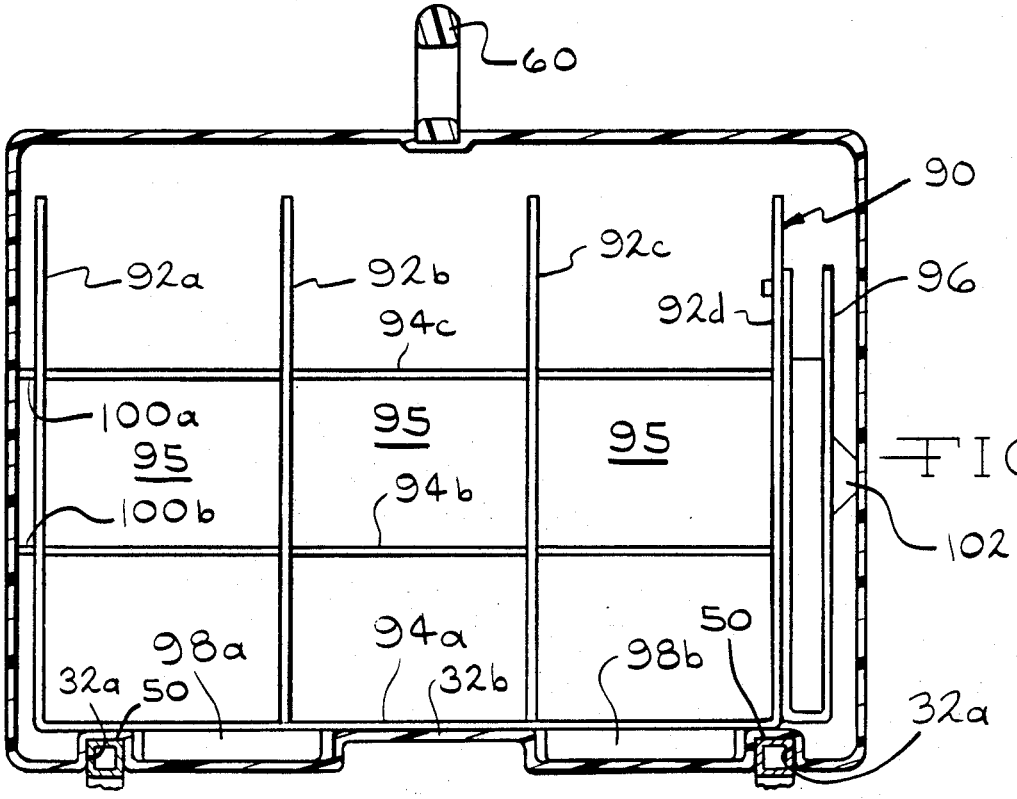
FIG. 10 is a sectional view taken along the line 10—10 in FIGS. 3 and 7 and illustrating the construction and position of the removable insert member, which is shown in elevation.

As shown in FIGS. 7 and 10, the lower panel 32 of the container 22 is provided with elongate recessed portions **32*a* for receiving the inclined members 50 and stabilizing the upper portion of the frame. The inclined members 50 are secured within the recessed portions 32*a* by fasteners 56 which, in the preferred embodiment of the invention, are conventional threaded fasteners. As shown in FIGS. 1 and 2, an axle 58 passes through apertures provided in the lower ends of the vertical members 52, and rotatably supports the pair of wheels 29**.

The top surface 30 of the container includes a handle 60 (shown in FIGS. 1 and 3) which can be utilized to relocate the cabinet. When desired, the display cabinet can be easily relocated by grasping the handle 60, tilting the cabinet rearwardly to disengage the U-shaped member 54 from the ground surface 28, and rolling the cabinet to the desired location. Also, as will be discussed, the handle 60 defines a stop surface **60*a* which, when the cover is raised to the open position as shown in FIG. 9, engages a cooperating stop surface 62*a* of a projection 62*a* formed in the rectangular portion 46 of the cover 24** to limit the pivoting movement of the cover and define the open position.

To increase the rigidity of the cabinet, and to improve the aesthetic appearance of the cabinet, the front panel 34 can be provided with a front raised portion **34*a* (shown in FIG. 7) and the side panels 38 and 40 can be provided with raised surface portions 38*a* and 40*a* (shown in FIG. 10). Since the preferred embodiment of the invention is intended to contain windshield wiper blades, the front surface 34 of the cabinet can also include indicia means 64** which function as a measuring scale to determine the length of the individual wiper blades to be replaced.

Figure 9:
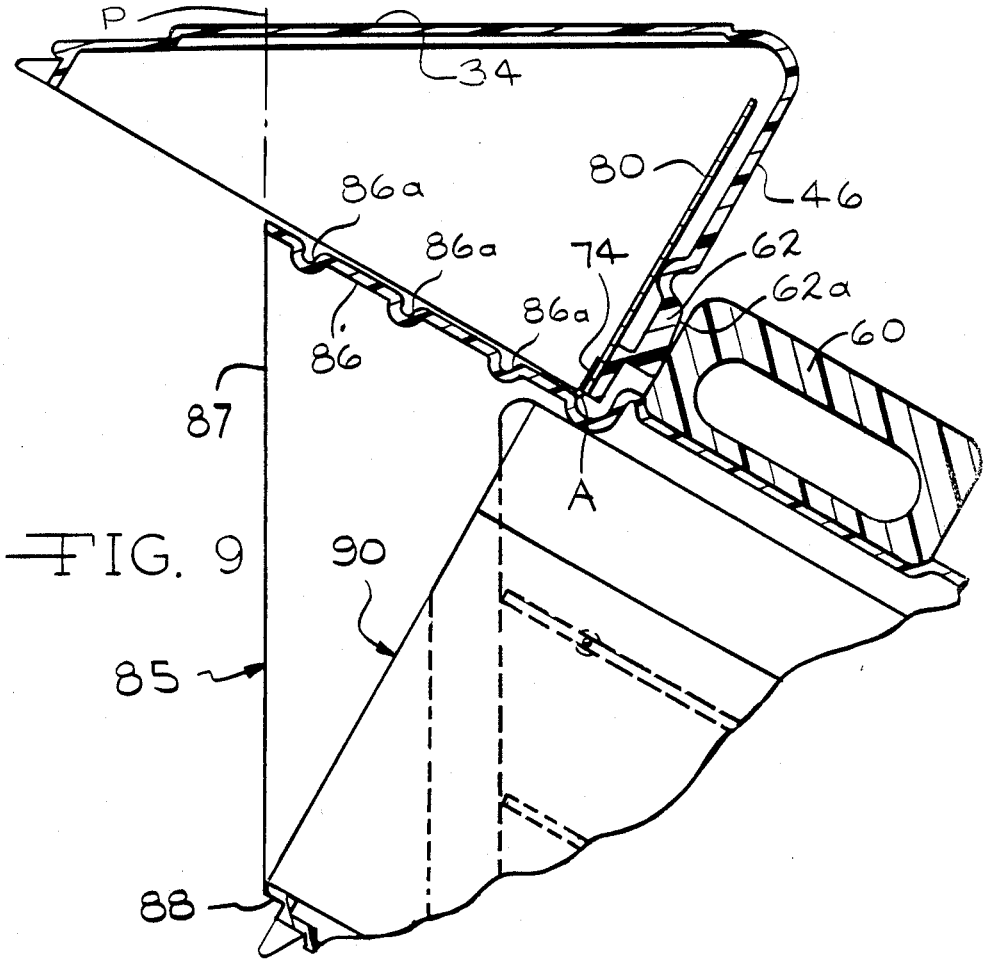
FIG. 9 is a fragmentary sectional view, similar to FIG. 7, but showing the cover in an open position.

Referring now to FIGS. 7 and 9, FIG. 7 illustrates the cover 24 in its closed position, while FIG. 9 illustrates the cover in its open position. The cover 24 is pivotally mounted to the container 22 about a pivot axis A by means of a hinge 74 having arm portions connected to the container 22 and the cover 24 by suitable fasteners such as, for example, rivets. When in its closed position, the cover 24 may be locked by the use of a padlock or the like (not shown) passing through apertures formed in cooperating locking tabs 76 and 78 which, as shown in FIG. 7, are formed at the lower front juncture of the cover 24 and the container 22.

In accordance with the present invention, the cover 24 is provided with a structure such that, when the cover is in the open position shown in FIG. 9, the front panel section 34 is spaced above and extends completely over the open end of the container. As shown in FIG. 9, the peripheral edge portion of the container opening is located in a plane P through which the front panel section 34 extends when the cover is in the open position.

As previously discussed, the pivotal movement of the cover 24 is limited by the engagement of the stop surface **62*a* on the projection 62 with the stop surface 60*a* on the handle 60. In order to maintain the cover in the open position shown in FIG. 9, the cover is provided with a counterweight means such as a steel plate 80 which is located adjacent the inside surface of the rectangular portion 46 and is fastened to the cover together with the hinge 74**. It will be appreciated that the particular design of the counterweight means can be varied in order to provide sufficient weight on one side of the pivot axis A to maintain the cover in a stable open position.

Figure 8:
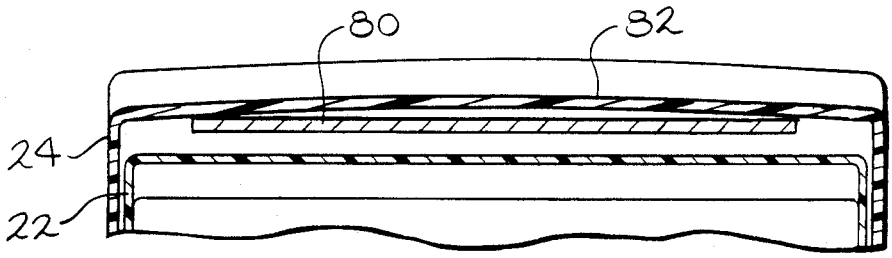
FIG. 8 is a sectional view taken along the line 8—8 in FIG. 7 and illustrating the sloped rain groove on the cover which is spaced upwardly from the hinged connection.

The display cabinet of the present invention is also provided with several other weather resistant features which cooperate to protect the contents of the cabinet. For example, as shown in FIG. 7, the upper rectangular portion 46 of the cover 24 is provided with a rain groove 82 spaced above the hinge connection point 74 between the cover and the container, while the container itself is provided with a second rain groove 84 immediately below and on the opposite side of the hinge 74. As shown in the sectional view of FIG. 8, the rain groove 82 in the cover provides an upwardly facing convex surface to prevent any accumulation of water within the groove. Also, as shown in FIG. 7, the rain groove 84 in the container adjacent the hinge 74 is recessed sufficiently to prevent the hinge from being immersed completely in water.

Another unique feature of the display cabinet relates to an extension portion 85 provided on the open end of the container which, when the cover is in the closed position, is received into the inner cavity defined by the cover 24. As shown in FIGS. 7 and 9, the extension portion includes a top portion 86 provided with a plurality of parallel spaced apart upwardly facing rain channels **86*a*, side portions 87, and a lower lip portion 88. When the cover is in the closed position shown in FIG. 7, the extension portion 85 cooperates with the side walls of the cover to prevent rain and wind blown dirt from entering the container. Further, when the cover is in the open position shown in FIG. 9, the extension portion will also shield the interior of the container from rain and wind blown dirt. Also, when the cover is in the open position, the upper rain channels 86*a* will tend to direct any rain or moisture which accumulates on the upper surface away from the hinge 74**.

Depending on the type of goods which are to be stored and displayed in the cabinet, it may be desirable to provide an insert member for the purpose of subdividing the interior of the container into individual compartments for selectively arranging the goods. As previously mentioned, the preferred embodiment of the display cabinet of the present invention is specifically designed for use in displaying windshield wiper blades. Accordingly, it has been found desirable to utilize an insert having a structure similar to an insert 90 shown in FIGS. 7 and 10. As shown in FIG. 10, the insert 90 includes a plurality of spaced apart parallel vertical wall members 92*a*, 92*b*, 92*c* and 92*d*, and a plurality of spaced apart generally parallel horizontal wall members 94*a*, 94*b*, 94*c* and 94*d* which function to subdivide the interior of the container into nine generally equally size compartments 95, each of which can be adapted to contain a wiper blade of a different length or style. A pamphlet or catalog holder 96 can be attached to the outside surface of the vertical wall member 92*d*.

The lower horizontal wall member 94*a* can be supported in spaced relationship with the inside of the lower panel 32 of the container by means of a pair of spaced apart downwardly extending tab members 98*a* and 98*b* and a centrally located raised portion 32*b* formed in the lower panel 32 which provides an inner upwardly facing support surface for the insert. The vertical side wall member 92*a* can be provided with tab members 100*a* and 100*b* for frictionally engaging the inner side wall of the container, while the pamphlet holder 96 can be provided with a tab member 102 for engaging the opposite side wall of the container. The tab members 100*a*, 100*b* and 102 can be designed to frictionally engage the inner walls of the container to securely retain the insert 90 within the container and resist removal thereof.

In the event moisture or rain does enter the container, the inclined arrangement of the bottom panel 32 of the container causes the water to flow to the lower rear edge of the container. As shown in FIG. 7, a pair of cooperating drain holes 104 and 106 are provided at this location for enabling water to drain therefrom.

In accordance with the provisions of the patent statutes, the principle and mode of operation of the present invention has been illustrated and described in its preferred embodiment. However, it should be noted that the present invention can be practiced otherwise than as specifically illustrated and described without departing from the spirit or scope of the attached claims.

What is claimed is:

1. An outdoor display cabinet comprising:

a container having an open end and adapted to contain a supply of goods to be displayed;

as cover pivotally attached to said container and adapted to close said open end, said cover moveable between a closed position wherein said open end is closed to an open position wherein said open end is open, said cover including a panel section which cooperates to close said open end when said cover is in its closed position, said panel section spaced above and extending completely over said open end when said cover is in the open position to shelter said open end and protect the interior of said container; and counterweight means fixedly attached to said cover for pivotal movement unitarily therewith, said counterweight means stabilizing and maintaining said cover in said open position.

2. The outdoor display cabinet according to claim 1 wherein said cover is moveable about a pivot axis, and said panel section of said cover is spaced from said pivot axis.

3. The outdoor display cabinet according to claim 1 wherein said container is provided with a stop means engagable with said cover for limiting the pivotal movement of said cover in one direction to define the open position.

4. The outdoor display cabinet according to claim 1 wherein said container includes a bottom wall provided with an aperture to permit drainage of fluids contained therein.

5. The outdoor display cabinet according to claim 1 including a support frame means secured to said container for supporting said container above a ground surface, said frame including wheel means for engaging the ground surface.

6. The outdoor display cabinet according to claim 5 wherein said container includes a handle portion for relocating the display cabinet.

7. The outdoor display cabinet according to claim 1 including an insert member positioned within said container, said insert member including means for dividing the interior of said container into a plurality of individual compartments.

8. The outdoor display cabinet according to claim 7 wherein said container includes a bottom wall and said insert member includes a bottom wall, and means for positioning said bottom wall of said insert member in spaced relationship from said bottom wall of said container.

9. The outdoor display cabinet according to claim 7 wherein said insert member is removably positioned within said container.

10. The outdoor display cabinet according to claim 1 wherein said panel section of said cover is a first panel section and wherein said cover includes a second panel section which faces generally upwardly when said cover is in its closed position, said second panel section including an edge portion hingedly attached to said container.

11. The outdoor display cabinet according to claim 10 wherein said second panel section of said cover is provided with a rain groove spaced from said edge portion.

12. The outdoor display cabinet according to claim 10 wherein said cabinet includes an inclined bottom wall and an inclined top wall, and said second panel section of said cover is hingedly attached to said inclined top wall.

13. The outdoor display cabinet according to claim 1 wherein said cover includes wall portions attached to said panel section to define an open ended cavity in facing relationship to the open end of said container, said container provided with an extension portion which extends into said cavity when said cover is in the closed position.

14. The outdoor display cabinet according to claim 1 wherein said cover is moveable aobut a pivot axis, and said counterweight means is located on one side of said pivot axis when said cover is in said closed position and on the other side of said pivot axis when said cover is in said open position.

15. An outdoor display cabinet comprising:

a container having an open end wall located in a plane, said container adapted to contain a supply of goods to be displayed;

a cover pivotally attached to said container and adapted to close said open end wall, said cover moveable between a closed position wherein said open end wall is closed to an open position wherein said open end wall is open, said cover including a panel section which cooperates to close said open end wall when said cover is in its closed positiion, said panel section spaced above said open end wall and intersecting and extending through said plane to overhang said open end wall when the cover is in the open position; and conterweight means for stabilizing and maintaining said cover in the open position, said counterweight means being fixedly secured to said cover for pivotal movement unitarily therewith.

16. An outdoor display cabinet comprising:

a container having an open end wall located in a plane, said container adapted to contain a supply of goods to be displayed;

a cover pivotally attached to said container along a pivot axis spaced from said plane, said cover moveable between a closed position wherein said open end wall is closed to an open position wherein said open end wall is open, said cover including a panel section spaced from said pivot axis and which cooperates to close said open end wall when said cover is in the closed position, said panel section spaced above and extending at least partially over said open end wall when said cover is in the open position to shelter said open end wall and protect the interior of the container;

counterweight means fixedly secured to said cover for stabilizing and maintaining said cover in said open position;

said container provided with a stop means engagable with said cover to limit the pivotal movement of said cover in one direction to define the open position.

17. The outdoor display cabinet according to claim 16 wherein said container includes a handle portion and wherei said stop means is formed on said handle portion.

18. The outdoor display cabinet according to claim 16 including a support frame means secured to said container for supporting said container above a ground surface, said frame including wheel means for engaging the ground surface.

19. The outdoor display cabinet according to claim 16 wherein said container includes an inclined top wall and an inclined bottom wall, and wherein a lowermost portion of said bottom wall is provided with an aperture to permit drainage of fluids contained therein.

20. The outdoor display cabinet according to claim 16 wherein said counterweight means is located on one side of said pivot axis when said cover is in said closed position and on the other side of said pivot axis when said cover is in said open position.

* * * * *